US007252091B1

(12) United States Patent
Wayne et al.

(10) Patent No.: US 7,252,091 B1
(45) Date of Patent: Aug. 7, 2007

(54) HAIR COLORANT APPLICATOR

(76) Inventors: Jim Wayne, J. W. Industries, Inc., 9555 Santa Monica Blvd., Beverly Hills, CA (US) 90210; Debra Dumas, 16 S. Ridgley Dr., Los Angeles, CA (US) 90036

( * ) Notice: Subject to any disclaimer, the term of this patent is extended or adjusted under 35 U.S.C. 154(b) by 0 days.

(21) Appl. No.: 11/380,368

(22) Filed: Apr. 26, 2006

(51) Int. Cl.
*A45D 24/22* (2006.01)

(52) U.S. Cl. ..... 132/112; 132/317; 401/132

(58) Field of Classification Search ..... 132/212, 132/317, 108–116, 294, 221; 206/219–222; 222/80, 129; 401/132–133, 40–42, 208, 401/281; 604/1–3
See application file for complete search history.

(56) References Cited

U.S. PATENT DOCUMENTS

| | | | | | |
|---|---|---|---|---|---|
| 3,347,410 | A | | 10/1967 | Schwartzman | |
| 3,404,811 | A | * | 10/1968 | Cernei | 222/83 |
| 3,548,562 | A | | 12/1970 | Schwartzman | |
| 3,768,697 | A | | 10/1973 | Lerner | |
| 3,786,820 | A | * | 1/1974 | Kopfer | 132/74.5 |
| 4,103,772 | A | | 8/1978 | Wiegner | |
| 4,606,734 | A | | 8/1986 | Larkn et al. | |
| 4,682,689 | A | | 7/1987 | Pereira et al. | |
| 4,789,261 | A | * | 12/1988 | Iwase et al. | 401/190 |
| 4,950,237 | A | * | 8/1990 | Henault et al. | 604/82 |
| 5,071,034 | A | | 12/1991 | Corbiere | |
| 5,692,644 | A | | 12/1997 | Gueret | |
| 5,778,902 | A | | 7/1998 | Nagy | |
| 5,860,569 | A | | 1/1999 | Gregoire | |
| 5,884,759 | A | | 3/1999 | Gueret | |
| 5,934,296 | A | * | 8/1999 | Clay | 132/320 |
| 6,065,641 | A | | 5/2000 | Laguna Valderrama | |
| 6,165,523 | A | | 12/2000 | Story | |
| 6,305,576 | B1 | | 10/2001 | Leoncavallo | |
| RE38,067 | E | | 4/2003 | Gueret | |
| 6,976,494 | B2 | * | 12/2005 | Wayne et al. | 132/108 |
| 7,025,200 | B2 | | 4/2006 | Fontana | |
| 2002/0066750 | A1 | * | 6/2002 | Albisetti | 222/143 |
| 2005/0007870 | A1 | * | 1/2005 | Faraldi et al. | 366/130 |
| 2005/0072442 | A1 | * | 4/2005 | Licari et al. | 132/112 |
| 2005/0252795 | A1 | * | 11/2005 | Peuker et al. | 206/222 |
| 2006/0144727 | A1 | * | 7/2006 | Fontana | 206/222 |

* cited by examiner

*Primary Examiner*—Robyn Doan
*Assistant Examiner*—Rachel A. Running
(74) *Attorney, Agent, or Firm*—Marshall A. Lerner; Marvin H. Kleinberg; Kleinberg & Lerner, LLP

(57) ABSTRACT

A hair colorant device capable of separately housing two volatile hair colorant solutions. The hair colorant device has two compartments used to store, introduce and mix the hair colorant solutions. When combined the two hair colorant solutions may be applied to a person's hair.

14 Claims, 5 Drawing Sheets

HAIR COLORANT APPLICATOR

BACKGROUND OF THE INVENTION

1. Field of the Invention

The present invention relates to a self-contained apparatus made for transporting, mixing and dispensing solutions for hair coloring, more particularly to an apparatus having at least two compartments containing solutions, capable of introducing the solutions to one another within the compartment and dispensing the mixture to a person's hair.

2. Description of the Related Art

The process of coloring a person's hair often requires the preparation of an unstable mixture of two or more solutions and applying the mixture to the person's hair prior to the mixture loosing effectiveness. Instrumental in attaining a favorable outcome and not damaging a person's hair is the consistency of the mixture, and time allotted between mixing the solutions and application to the person's hair. Common practice in hair coloring involves opening the two or more solutions, mixing the solutions in a container, and often transferring the mixture to an application friendly container prior to application to a person's hair. Often the mixing containers can only be used one time due to the volatility of the solutions. This process is often repeated several times in one coloring session due to the short effective time of the mixture, leading to wasted time, effort, containers, as well as creating a mess.

The present invention recognizes and addresses the particular need for an efficient, inexpensive alternative that can be safely used by professional hair dressers as well as the general public.

SUMMARY OF THE INVENTION

It is an object of the present invention to provide a disposable hair colorant apparatus capable of housing volatile hair colorant solutions independently for an extended period of time, until they are applied to a person's hair. The invention provides a self-contained means by which to introduce and mix the volatile solutions with one another at the time the hair colorant is to be applied, and an application means for introducing the mixture to a person's hair.

In accordance with the present invention, a first component comprises an end cap, and a first solution housing. The end cap has a protrusion devise attached at one end, the protrusion device has a sharp edge designed to rupture a frangible membrane. The first solution housing contains a collapsible bulbous tubular body, preferably of an accordion type collapsible structure, designed to subside when forcibly engaged causing the protrusion device to rupture the frangible membrane. The first solution housing contains a hair colorant solution and is attached to the end cap. The attachment point contains a sealing means designed to prevent the solutions from leaking.

The second compartment comprises a diaphragm means containing a frangible membrane, a second solution housing for containing a hair colorant solution, attached to the diaphragm means, and an applicator attached to the second solution housing. The attachment point contains a sealing means designed to prevent the solutions from leaking. The applicator contains an applicator tip, preferably of porous wick material, and a twist-top stop valve mechanism which regulates the flow of liquid from the first solution housing and second solution housing to the applicator tip. The stop valve device contains a sealing means used to prevent the leakage of solution. The applicator features a cap devise used to protect and keep hygienic the applicator tip during shipment and prior to use.

When force is applied to the end cap of the hair colorant applicator the collapsible bulbous tubular body subsides, causing the protrusion device to rupture the frangible membrane. The primary function of the frangible membrane is to keep separate the volatile solutions. Upon rupture of the frangible membrane the solutions interact creating an active mixture. The mixture is fed through the applicator to the applicator tip where it is introduced to the individual's hair.

BRIEF DESCRIPTION OF THE DRAWINGS

The descriptions which follow are to be understood as illustrative and exemplary of specific structures, aspects and features within the broad scope of the present invention and not as limiting of such broad scope. Like numbers refer to similar features of like elements throughout.

DESCRIPTION OF THE PREFERRED EMBODIMENTS

Figure 1:
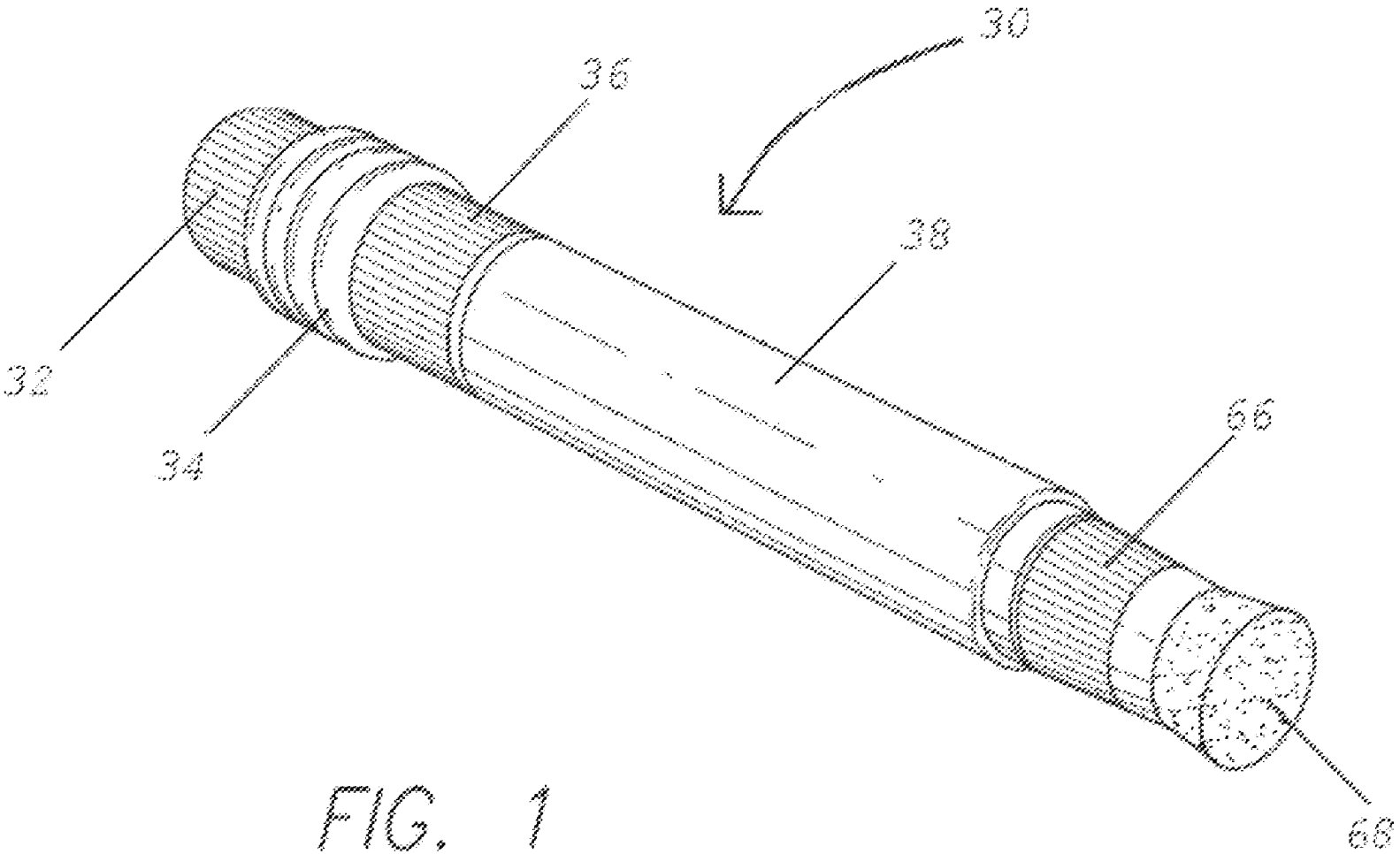
FIG. 1 is a perspective view of a hair colorant applicator in accordance with the present invention.

The invention will now be described with reference to FIG. 1, which illustrates the hair colorant hair colorant applicator 30 in a perspective view, depicting the end cap 32, first solution housing 34, diaphragm means 36, second solution housing 38, and applicator 66 of the invention.

With continued reference to FIG. 1, the hair colorant applicator 30 comprises the end cap 32 attached to the first solution housing 34. The first solution housing 34 is attached to the diaphragm means 36 which is attached to the second solution housing 38. The second solution housing 38 is attached to the applicator 66.

Figure 2:
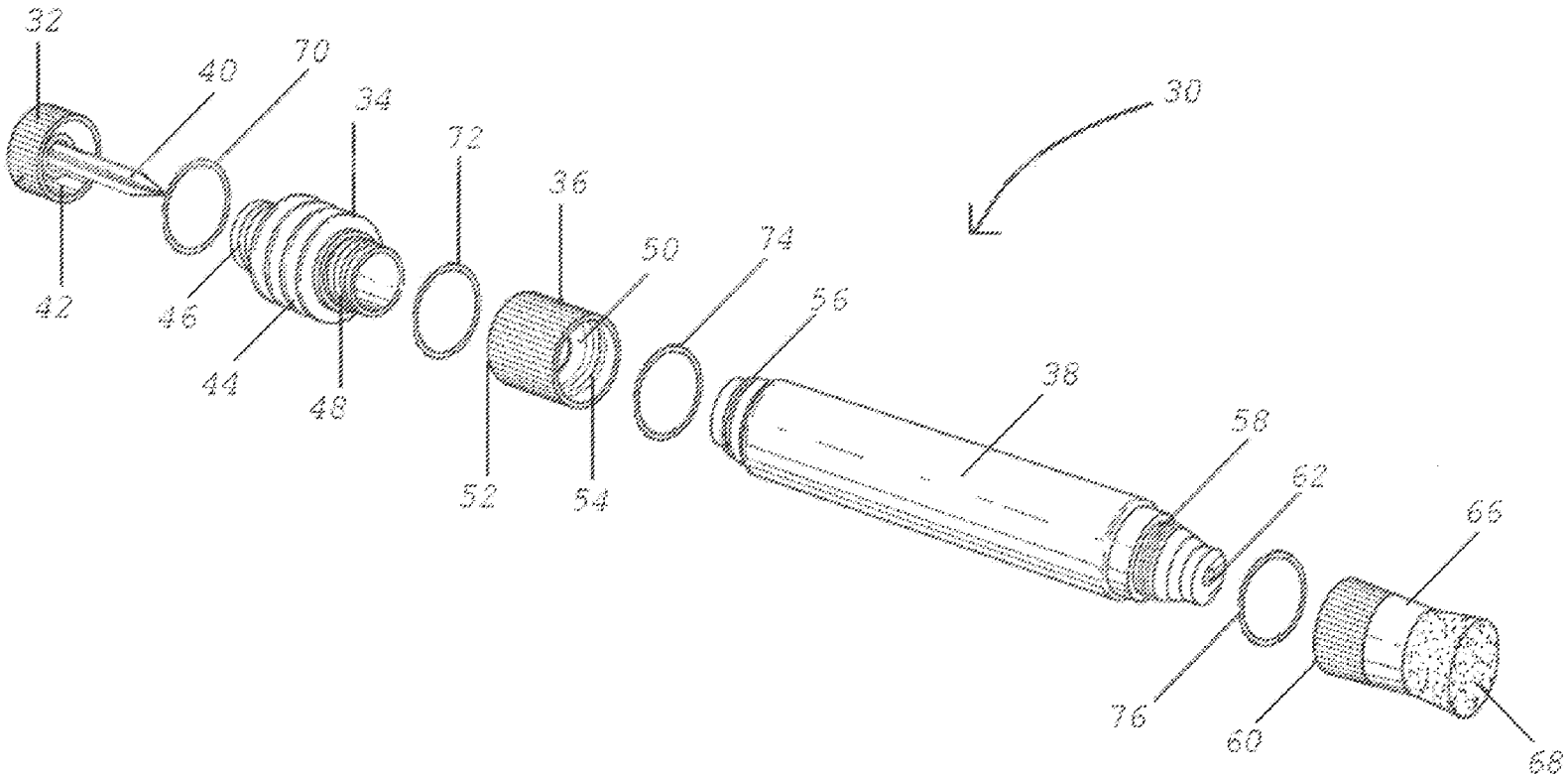
FIG. 2 is a perspective view of a hair colorant applicator with each of the five segments separated.

FIG. 2, is a disassembled perspective view of the hair colorant applicator 30 depicting the end cap 32 comprising an internally threaded end cap proximal end 42, a protrusion device 40 attached to the end cap 32 and an end cap seal 70. The first solution housing 34 has a collapsible bulbous body 44 and an externally threaded first solution housing distal end 46 and an externally threaded first solution housing proximal end 48. The externally threaded first solution housing distal end 46 is matted to the internally threaded end cap proximal end 42 to attach the end cap 32 to the first solution housing 34. The end cap seal 70 is configured between the end cap 32 and first solution housing 34 to create an impermeable seal. The diaphragm means 36 has a thin frangible membrane 50, shown in FIG. 3, capable of being ruptured by the protrusion device 40. The diaphragm means 36 has internally threaded diaphragm means distal end 52 and internally threaded diaphragm means proximal end 54. The internally threaded diaphragm means distal end 52 is matted to the externally threaded first solution housing proximal end 48 to attach the first solution housing 34 to the diaphragm means 36. A first solution seal 72 is configured between the first solution housing 34 and the diaphragm means 36 to create an impermeable seal.

The second solution housing 38 has an externally threaded second solution housing distal end 56 and an externally threaded second solution housing proximal end 58. The externally threaded second solution housing distal end 56 is mated to the internally threaded diaphragm means proximal end 54 to attach the diaphragm means 36 to the second solution housing 38. A Second solution housing seal 74 is configured between the diaphragm means 36 and second solution housing 38 to create an impermeable seal. The applicator 66 has an applicator tip 68 and an internally threaded applicator distal end 60 mated to the externally threaded second solution housing proximal end 58 to attach the second solution housing 38 to the applicator 66.

Figure 5:
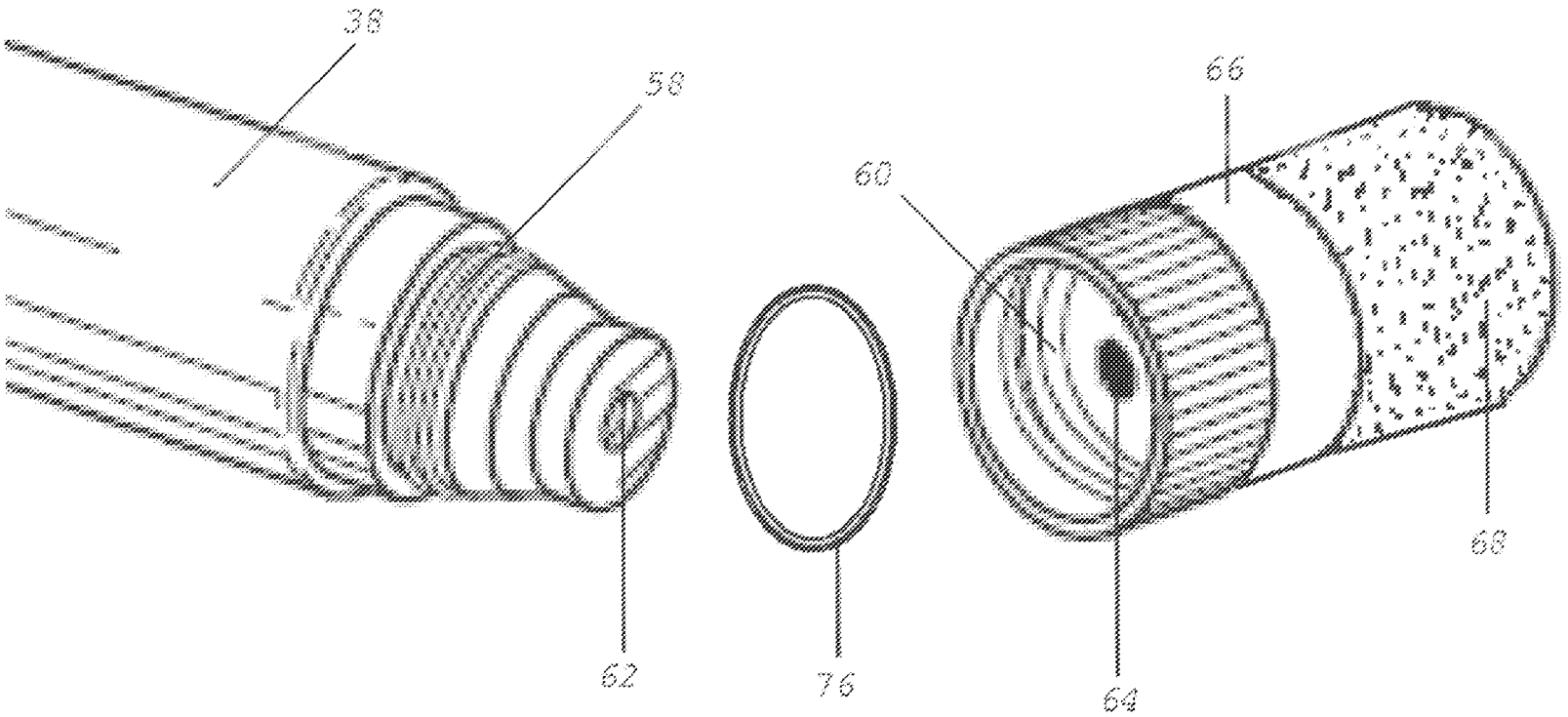
FIG. 5 is an exploded view of the hair colorant applicator's second solution housing and applicator detailing the functional stop valve device.

Further to FIG. 2, the second solution housing 38 has an opening 62 at the proximal end. As shown in FIG. 5, the opening 62 is sealed by rotating the applicator 66 allowing the externally threaded second solution housing proximal end 58 to thread onto the internally threaded applicator distal end 60. An applicator seal 76 is configured between the second solution housing 38 and applicator 66 to create an impermeable seal when the applicator 66 is rotated to its closed position.

Figure 3:
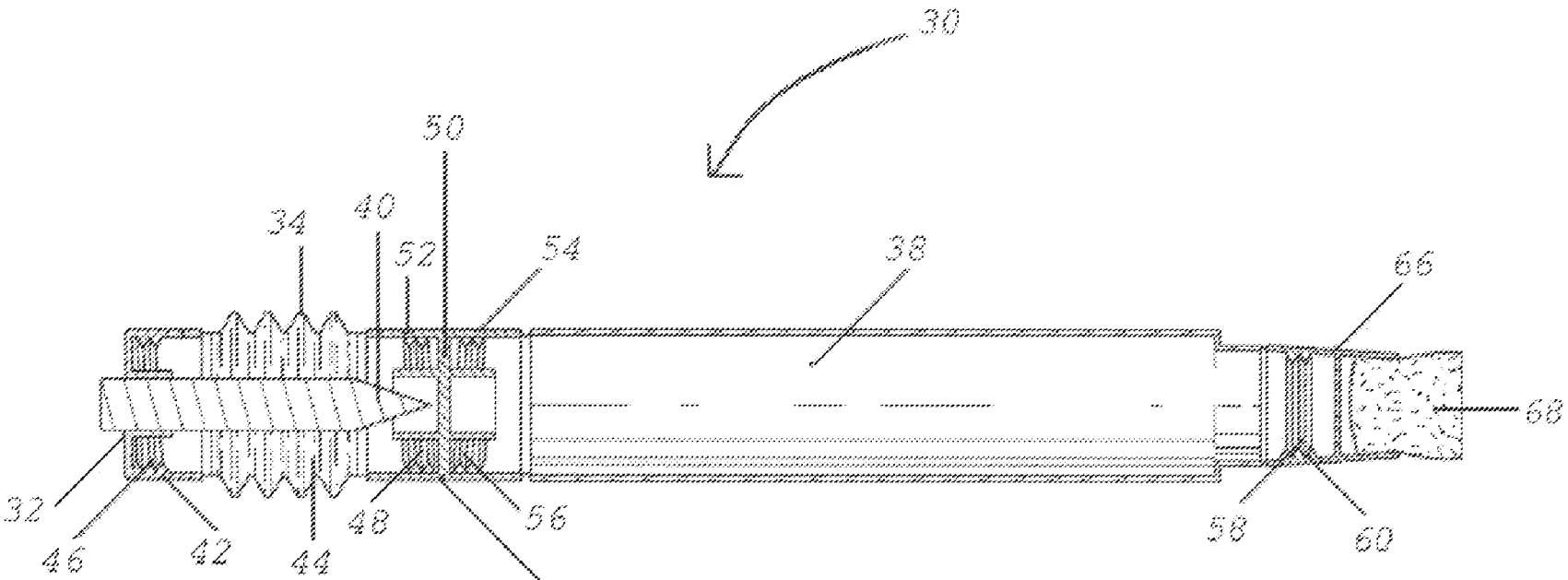
FIG. 3 is a cross sectional side view of a hair colorant applicator in accordance with the present invention.

FIG. 3, is a cross-sectional view of the hair colorant applicator 30 before any pressure is applied to the end cap 32, thus depicting the collapsible bulbous tubular body 44 at rest. The end cap 32 has an internally threaded end cap proximal end 42 and a protrusion device 40 attached to end cap 32. The first solution housing 34 has a collapsible bulbous tubular body 44, an externally threaded first solution housing distal end 46 and an externally threaded first solution housing proximal end 48. The externally threaded first solution housing distal end 46 is threaded to the end cap proximal end 42 sealing the end cap 32 to the first solution housing 34 which has the protrusion device 40 resting near the frangible membrane 50. The diaphragm means 36 has an internally threaded diaphragm means distal end 52 and an internally threaded diaphragm means proximal end 54. The internally threaded diaphragm means distal end 52 is threaded to the externally threaded first solution housing proximal end 48 sealing the first solution housing 34 to the diaphragm means 36.

The second solution housing 38 has an externally threaded second solution housing distal end 56 and an externally threaded second solution housing proximal end 58. The externally threaded second solution housing distal end 56 is attached to the internally threaded diaphragm means proximal end 54 sealing the diaphragm means 36 to the second solution housing 38.

The applicator 66 has an applicator tip 68, and an internally threaded applicator distal end 60 attached to the externally threaded second solution housing proximal end 58 sealing the second solution housing 38 to the applicator 66.

FIG. 3 depicts the first tubular housing 34 before any pressure is applied to the collapsible bulbous tubular body 44. The second solution housing 38, functions to independently retain a second hair coloring solution before any pressure is applied to the collapsible bulbous tubular body 44

Figure 4:
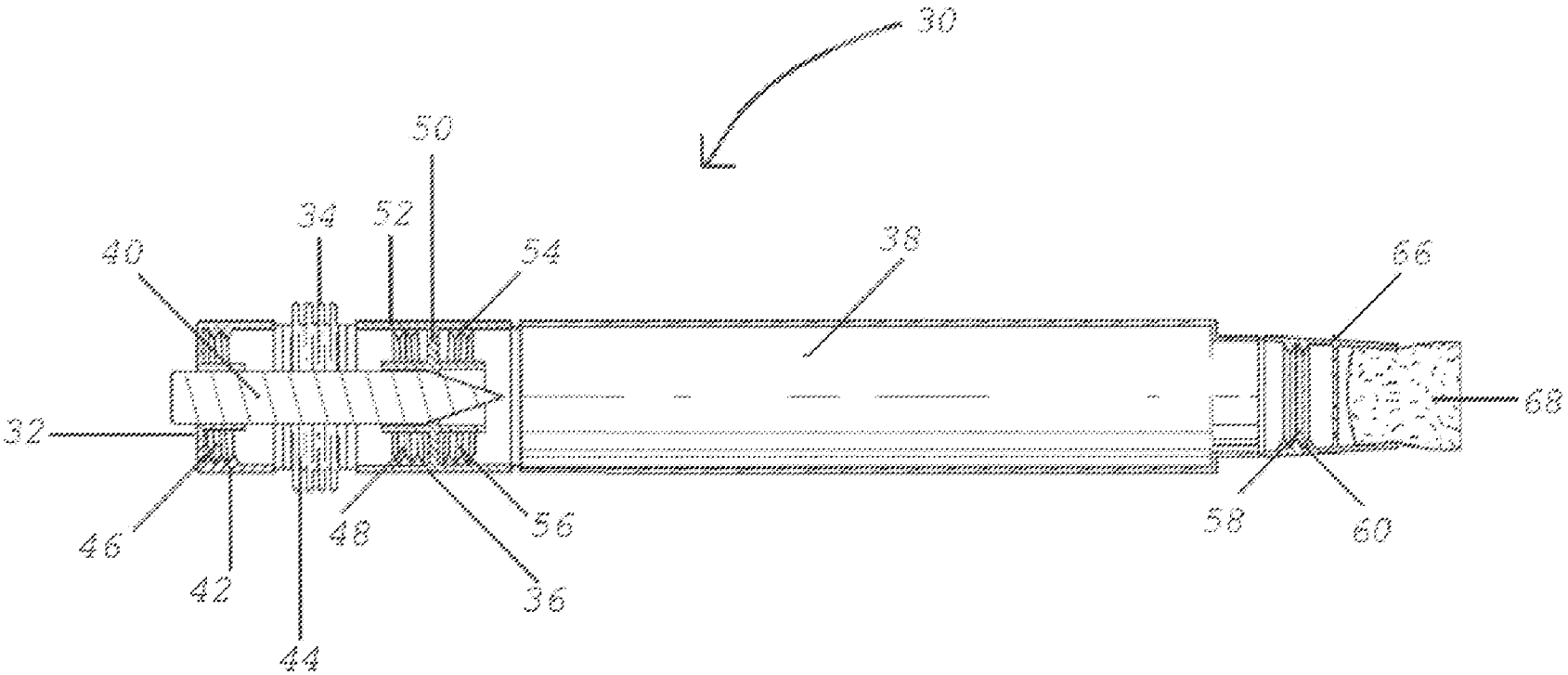
FIG. 4 is a cross sectional side view of a hair colorant applicator in accordance with the present invention, with the first solution housing compressed.

FIG. 4, shows a cross-sectional view of the hair colorant applicator 30 seen in FIG. 3, after pressure is applied to the end cap 32. The pressure applied to the end cap 32 compresses the collapsible bulbous tubular body 44 which forces the protrusion device 40 to rupture the frangible membrane 50. By rupturing the frangible membrane, the independent hair coloring solutions found in the first solution housing 34 and the second solution housing 38, are forcibly introduced to each other creating a mixture.

FIG. 5, is a expanded view of the hair colorant applicator's 30 second solution housing 38 and applicator 66 detailing the externally threaded second solution housing proximal end 58, internally threaded applicator distal end 60, and the applicator seal 76. The opening 62 and functional stop valve device 64 work in unison to control the flow of solution through the opening 62 to the applicator 66.

Further to FIG. 5, the complementing externally threaded second solution housing 38 having a proximal end 58 and the internally threaded applicator 66 having a distal end 60 may be rotated with respect to each other to thereby urge the stop valve 64, against the opening 62 restricting the passage of fluid. The housing 38 and applicator 66 may be rotated with respect to each other in the opposite direction to open the stop valve device 64 releasing the solution to the applicator 66. The applicator seal 76 is configured between the second solution housing 38 and applicator 66 to create an impermeable seal when the applicator 66 is rotated to its sealed position.

In the operation of the invention, the hair colorant applicator 30 is at rest in the state depicted in FIG. 3, where the collapsible bulbous tubular body 44 has not subsided because force has not been applied to the end cap 32. As FIG. 3 shows, the protrusion device 40 rests near the frangible membrane 50, which is intact. The purpose of the frangible membrane 50 is to keep separate the volatile solutions found in said first solution housing 34 and second solution housing 38.

To initiate use of the hair colorant hair colorant applicator 30, ample pressure is applied to the end cap 32 of the hair colorant applicator 30, causing the collapsible bulbous tubular body 44 to subside. As the collapsible bulbous tubular body 44 subsides, the protrusion device 40 is thrusted forward through the frangible membrane 50. FIG. 4 shows the frangible membrane 50 ruptured by the protrusion device 40. Rupturing the frangible membrane 50 causes the solutions found in the first solution housing 34 and second solution housing 38 to be introduced to one another and combine to form a mixture. The mixture is now active and ready to be applied to a person's hair. The applicator 66 is adjusted to allow for the flow of the mixture to the applicator tip 68, where it is introduced to the person's hair. Upon completion or pause of the application of the mixture to a person's hair, the applicator 66 may be adjusted to cease the flow of the mixture to the applicator tip 68.

Optionally pressure may be applied and released upon the end cap 32 several times to facilitating the mixing of the solutions in the first solution housing 34 and second solution housing 38. Optionally, the hair colorant applicator 30 may be inverted several times to facilitate the mixing of the solutions.

While the foregoing detailed description has described several embodiments of a hair colorant applicator 30 in accordance with the present invention, it is to be understood that the above description is illustrative only and not limiting of the disclosed invention. Indeed, it will be appreciated that the embodiments discussed above and the virtually infinite embodiments that are not mentioned could easily be within the scope and spirit of the present invention. Thus, the present invention is to be limited only by the claims as set forth below.

What is claimed is:

1. A hair colorant mixing and application apparatus containing:

an end cap, a protrusion device, and a first solution housing, said protrusion device connected to said end cap and adapted for forcible engagement of a frangible membrane, said first solution housing being adapted to be connected to said end cap;

said first solution housing defined between the distal end of said end cap and said frangible membrane, said first solution housing being open at both ends, said first solution housing being capable of retaining a hair coloring solution and being entirely made up of a collapsible bulbous tubular body, said collapsible bulbous tubular body designed to subside under forcible engagement;

diaphragm means adapted to be connected to said first solution housing and containing a frangible membrane capable of being ruptured by said protrusion device;

a second solution housing adapted to be connected to said diaphragm means;

said second solution housing being capable of retaining a hair colorant;

an applicator attached to said second tubular housing and distinct from said end cap, said applicator containing an application tip for applying a hair colorant mixture;

wherein the collapsing of said first solution housing completely collapses said collapsible bulbous tubular body forcibly rupturing said frangible membrane using said protrusion device and simultaneously injecting the entire contents of said first solution housing into said second solution housing; and whereby pressure applied to said end cap subsides said collapsible bulbous tubular body forcing said protrusion device to rupture said frangible membrane allowing solutions in said first solution housing and said second solution housing to interact creating a mixture, which is applied through said applicator.

2. A hair colorant mixing and application apparatus as set forth in claim 1, wherein said applicator contains a stop valve device capable of adjusting the desired flow of said mixture to said application tip.

3. A hair colorant mixing and application apparatus as set forth in claim 2, wherein said stop valve device contains a sealing means for confining a liquid.

4. A hair colorant mixing and application apparatus as set forth in claim 1, wherein said first solution housing and said second solution housing contain sealing means for confining a liquid.

5. A hair colorant mixing and application apparatus as set forth in claim 1, wherein said collapsible bulbous tubular body returns to near original form when pressure is released.

6. A hair colorant mixing and application apparatus as set forth in claim 1, wherein said applicator includes a porous wick.

7. The hair colorant mixing and application apparatus as set forth in claim 1, wherein said end cap is connected to said first solution housing by means of a set of corresponding male and female threads.

8. The hair colorant mixing and application apparatus as set forth in claim 1, wherein the compression of said collapsible bulbous tubular body injects the entire contents of said first solution housing into said second solution housing.

9. The hair colorant mixing and application apparatus as set forth in claim 1, wherein said mixture may be dispensed through said applicator directly from said second solution housing.

10. The hair colorant mixing and application apparatus as set forth in claim 1, wherein said first solution housing is connected to said diaphragm means by a set of corresponding male and female threads.

11. The hair colorant mixing and application apparatus as set forth in claim 1, wherein said second solution housing is connected to said diaphragm means by a set of corresponding male and female threads.

12. The hair colorant mixing and application apparatus as set forth in claim 1, wherein said second solution housing is capable of being collapsed so as to apply pressure to said mixture for application.

13. A hair colorant mixing and application apparatus containing:

an end cap, a protrusion device, and a first solution housing, said protrusion device connected to said end cap and adapted for forcible engagement of a frangible membrane, said first solution housing being adapted to be connected to said end cap;

said first solution housing defined between the distal end of said end cap and said frangible membrane, said first solution housing being open at both ends to enable connection to said end cap and said frangible membrane, said first solution housing being capable of retaining a hair coloring solution and being entirely made up of a collapsible bulbous tubular body, said collapsible bulbous tubular body designed to subside under forcible engagement;

diaphragm means adapted to be connected to said first solution housing using a set of corresponding male and female threads and containing a frangible, resilient membrane capable of being ruptured by said protrusion device;

a second solution housing adapted to be connected to said diaphragm means using a set of corresponding male and female threads;

said second solution housing being capable of retaining a hair colorant;

an applicator attached to said second tubular housing, said applicator containing an application tip including a porous wick for applying a hair colorant mixture, said applicator further comprised of a flow-controlling valve;

wherein the collapsing of said first solution housing completely collapses said collapsible bulbous tubular body forcibly rupturing said frangible membrane using said protrusion device and simultaneously injecting the entire contents of said first solution housing into said second solution housing; and whereby pressure applied to said end cap subsides said collapsible bulbous tubular body forcing said protrusion device to rupture said frangible membrane allowing solutions in said first solution housing and said second solution housing to interact creating a mixture, which is applied through said applicator.

14. A hair colorant mixing and application apparatus comprising:

an end cap adapted for threaded connection to only a first collapsible solution housing end;

a protrusion device, incorporated into the interior of said end cap, for use in forcibly engaging and thereby rupturing a diaphragm means;

said collapsible solution housing comprising:

a first collapsible solution housing end, adapted for threaded connection to said end cap, a second collapsible solution housing end, opposite of said first collapsible solution housing end, adapted for threaded connection to a joining member, and a collapsible bulbous tubular body, defined between said first and second collapsible solution housing ends, capable of retaining a hair colorant solution;

said joining member comprising:

a first joining member end, adapted for threaded connection to said second collapsible solution housing end, a second joining member end, adapted for threaded connection to a tubular solution housing, and a diaphragm means, suspended between said first and second joining member ends, capable of being ruptured upon forcible engagement with said protrusion device;

said tubular solution housing comprising:

a first tubular solution housing end adapted for threaded connection to said second joining member end, a second tubular solution housing end adapted for threaded connection to an applicator, and a tubular body portion, defined between said first and second tubular solution housing ends, capable of retaining hair colorant solution;

said applicator, distinct from said end cap, comprising:

a threaded applicator end, adapted for connection to said second tubular solution housing end, and an applicator tip, suitable for dispensation of a hair colorant mixture from said tubular solution housing;

wherein said collapsible bulbous tubular body completely collapses in response to pressure applied to said end cap, thereby causing said protrusion device to rupture said diaphragm means and to forcibly inject the entire contents of said collapsible solution housing into said tubular solution housing;

wherein said tubular solution housing thereupon fills with the entire contents of said collapsible solution housing to thereby create said hair colorant mixture; and wherein said hair colorant mixture may then be applied through said applicator tip by means of the application of pressure to said tubular solution housing.

* * * * *